US008986035B2

(12) United States Patent
Lai

(10) Patent No.: US 8,986,035 B2
(45) Date of Patent: Mar. 24, 2015

(54) SECURING MEMBER FOR A CONNECTOR

(71) Applicant: Yung Li Co., Ltd., New Taipei (TW)

(72) Inventor: Wen-Da Lai, New Taipei (TW)

(73) Assignee: Yung Li Co., Ltd (TW)

( * ) Notice: Subject to any disclaimer, the term of this patent is extended or adjusted under 35 U.S.C. 154(b) by 70 days.

(21) Appl. No.: 14/029,195

(22) Filed: Sep. 17, 2013

(65) Prior Publication Data

US 2014/0329402 A1 Nov. 6, 2014

(30) Foreign Application Priority Data

May 1, 2013 (TW) ..... 102208036 U

(51) Int. Cl.
*H01R 13/62* (2006.01)
*H01R 13/627* (2006.01)
*H01R 13/504* (2006.01)

(52) U.S. Cl.
CPC ..... *H01R 13/6275* (2013.01); *H01R 13/62* (2013.01); *H01R 13/5045* (2013.01)
USPC ..... 439/345

(58) Field of Classification Search
CPC ..... H01R 12/5045; H01R 13/62
See application file for complete search history.

(56) References Cited

U.S. PATENT DOCUMENTS

| | | | | |
|---|---|---|---|---|
| 6,352,447 | B1 * | 3/2002 | Ruth | 439/540.1 |
| 8,840,417 | B2 * | 9/2014 | Chang | 439/345 |
| 2005/0101169 | A1 * | 5/2005 | Ratcliffe | 439/106 |
| 2008/0076291 | A1 * | 3/2008 | Ewing et al. | 439/373 |
| 2014/0227897 | A1 * | 8/2014 | Chang | 439/345 |

* cited by examiner

*Primary Examiner* — Ross Gushi
(74) *Attorney, Agent, or Firm* — Schwegman Lundberg & Woessner, P.A.

(57) ABSTRACT

A securing member adapted for securely connecting a male connector member and a female connector member of a connector of IEC60320 standard. The securing member includes a main body including an inner wall, an outer wall and an end wall interconnecting the inner and outer walls. The inner, outer and end walls cooperatively define a receiving space adapted for receiving fittingly and separably at least part of an open end portion of a surrounding wall of the male connector member, and abutting respectively and separably against inner, outer and distal surfaces of the open end portion. The main body is adapted to engage an insertion groove of the female connector member fittingly and removably.

9 Claims, 9 Drawing Sheets

SECURING MEMBER FOR A CONNECTOR

CROSS-REFERENCE TO RELATED APPLICATION

This application claims priority of Taiwanese Application No. 102208036, filed on May 1, 2013.

BACKGROUND OF THE INVENTION

1. Field of the Invention

The invention relates to a securing member, more particularly to a securing member for a connector in compliance with IEC60320.

2. Description of the Related Art

FIG. 1 is a perspective view of a standard connector including a male connector member 5 and female connector member 6. The female connector member 6 has an annular insertion groove 61 surrounding an axis, and a plurality of first terminals 62 surrounded by the insertion groove 61. The male connector member 5 has a surrounding wall 51 surrounding the axis and having an open end portion that is inserted removably into the insertion groove 61, and a plurality of second terminals 52 surrounded by the surrounding wall 51 and connected respectively, electrically and removably to the first terminals 62.

IEC60320 standards require a gap to exist when the surrounding wall 51 of the male connector member 5 is inserted into the insertion groove 61 of the female connector member 6. However, the connection between the surrounding wall 51 and the insertion groove 61 can be loose without any securing mechanism and the male connector member 5 can easily disconnect from the female connector member 6 and cause a breakage in the electrical connection.

SUMMARY OF THE INVENTION

Therefore, the object of the present invention is to provide a securing member that allows the male connector member to be connected to the female connector member securely.

Accordingly, a securing member of the present invention is adapted for use with an IEC60320 connector. The connector includes a female connector member and a male connector member. The female connector member has an insertion groove surrounding an axis and a plurality of first terminals surrounded by the insertion groove. The male connector member has a surrounding wall surrounding the axis and has an open end portion that is inserted removably into the insertion groove. The male connector member further has a plurality of second terminals surrounded by the surrounding wall and connected respectively, electrically and removably to the first terminals. The open end portion has an inner surface, an outer surface surrounding the inner surface, and a distal surface interconnecting the inner and outer surfaces.

The securing member includes a main body that includes an inner wall, an outer wall and an end wall interconnecting the inner and outer walls. The inner, outer and end walls cooperatively define a receiving space adapted for receiving fittingly and separably at least part of the open end portion of the surrounding wall of the male connector member, and abutting respectively and separably against the inner, outer and distal surfaces of the open end portion of the surrounding wall of the male connector member. The main body is adapted to engage the insertion groove of the female connector member fittingly and removably.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
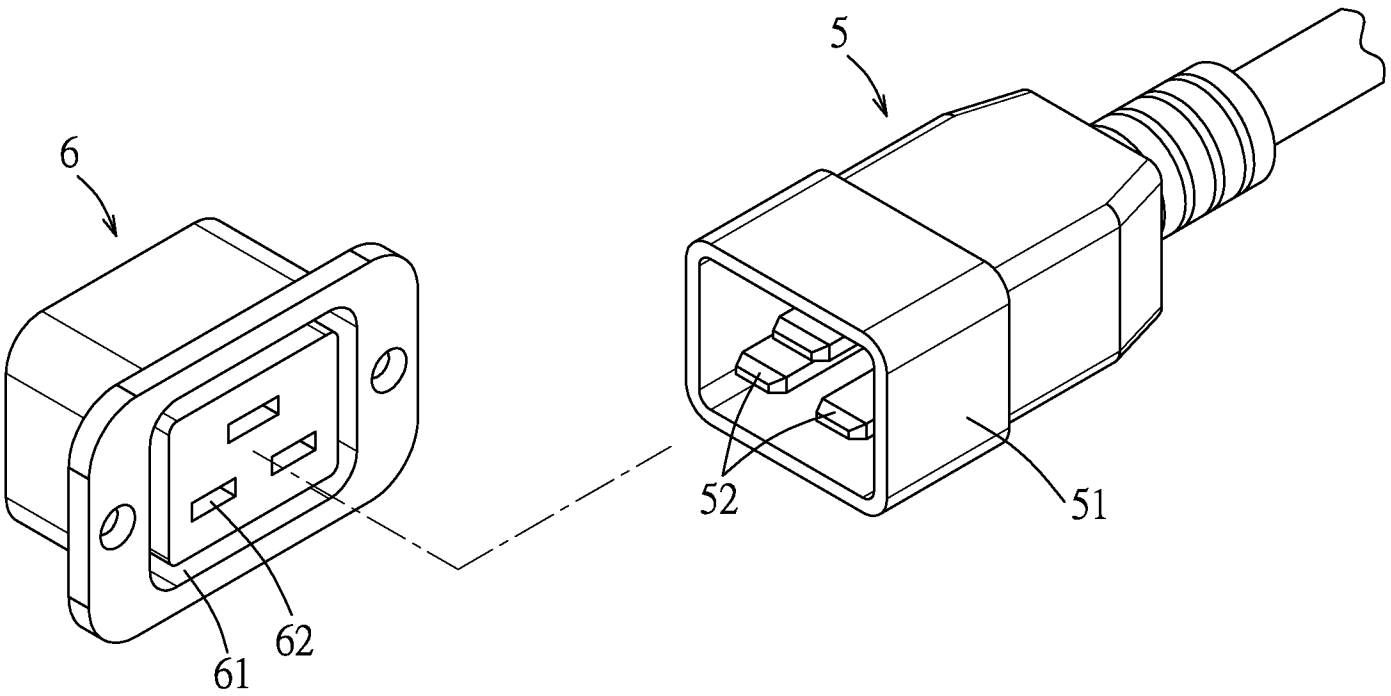
FIG.1 PRIOR ART
FIG. 1 is a perspective view of an exemplary existing IEC60320 connector, illustrating a female connector member and a male connector member.

Before the present invention is described in greater detail, it should be noted that like elements are denoted by the same reference numerals throughout the disclosure.

Figure 2:
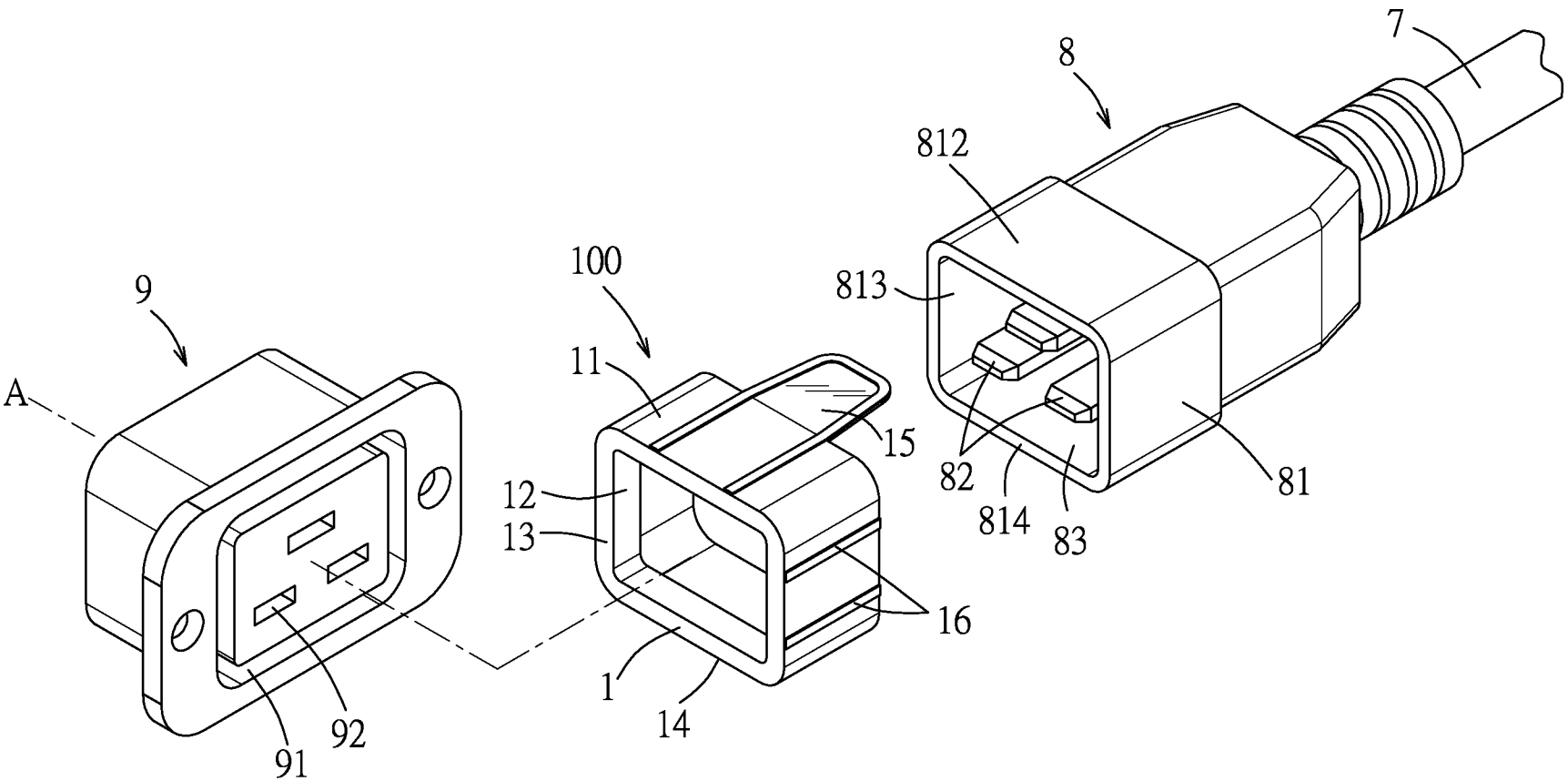
FIG. 2 is a perspective view of the first preferred embodiment of a securing member according to the present invention, illustrating relationships among the female connector member and the male connector member of the IEC60320 connector and the securing member.
Figure 3:
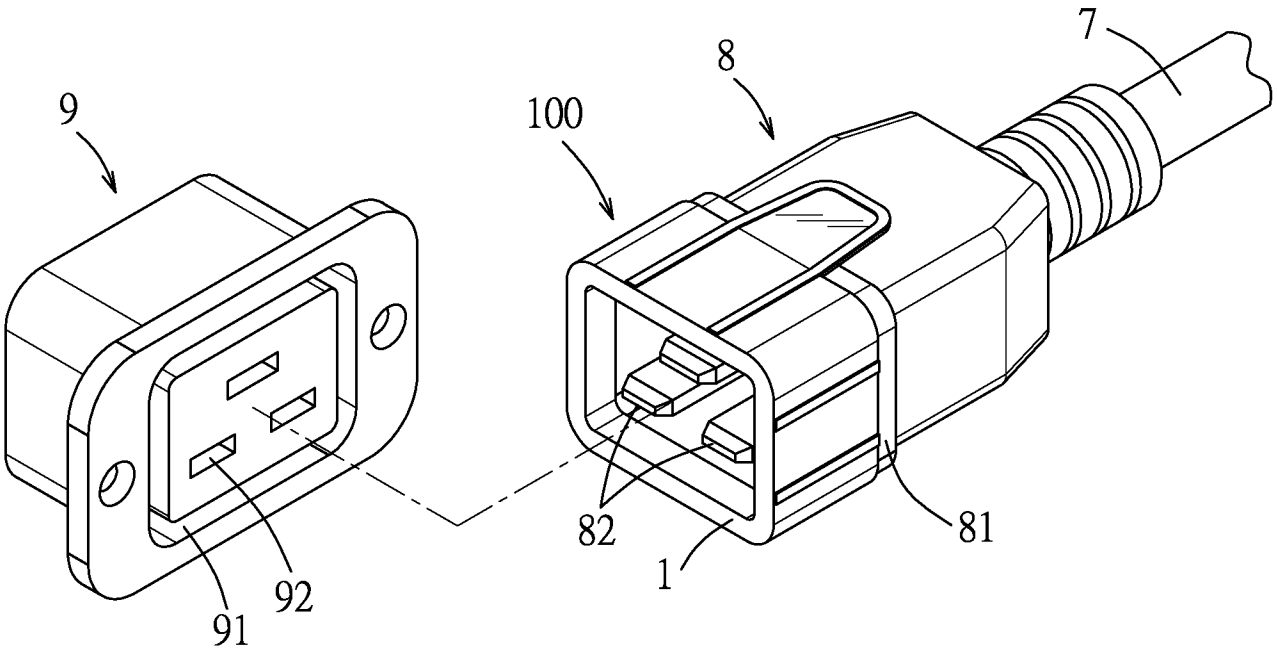
FIG. 3 is a perspective view of the first preferred embodiment, illustrating the securing member assembled to the male connector member.

Referring to FIGS. 2 and 3, the first preferred embodiment of a securing member 100 according to the present invention allows a male connector member 8 to be connected to a female connector member 9 securely. The female connector member 9 has an insertion groove 91 surrounding an axis (A) and a plurality of first terminals 92 surrounded by the insertion groove 91. The male connector member 8 has a surrounding wall 81 surrounding the axis (A) and having an open end portion 83 that is inserted removably into the insertion groove 91, and a plurality of second terminals 82 surrounded by the surrounding wall 81 and connected respectively, electrically and removably to the first terminals 92. The open end portion 83 has an inner surface 813, an outer surface 812 surrounding the inner surface 813 and a distal surface 814 interconnecting the inner surface 813 and the outer surface 812.

The securing member 100 includes a main body 1 that includes an inner wall 12, an outer wall 11 and an end wall 13 interconnecting the inner wall 12 and the outer wall 11. The inner wall 12, the outer wall 11 and the end wall 13 cooperatively define a receiving space 14 adapted for receiving fittingly and seperably at least part of the open end portion 83 of the surrounding wall 81 of the male connector member 8. The inner wall 12, the outer wall 11 and the end wall 13 abut respectively and seperably against the inner surface 813, the outer surface 812 and the distal surface 814 of the open end portion 83 of the surrounding wall 81 of the male connector member 8.

To attach the securing member 100 to the male connector member 8, the open end portion 83 moved towards the end wall 13 along the axis (A) until the distal surface 814 of the open end portion 83 abut against the end wall 13. Removal of the securing member 100 is achieved by moving in the opposite direction. With the abutment between the distal surface 814 and the end wall 13, it is ensured that the securing member 100 does not move any further towards a cable 7 connected to the male connector member 8. Therefore, the main body 1, together with the surrounding wall 81, fit in the insertion groove 91 of the female connector member 9 when the male connector member 8 is inserted into the female connector member 9. Because the main body 1 fills the gap between the surrounding wall 81 and the insertion groove 91, the male connector member 8 engages the female connector member 9 fittingly and securely.

The main body 1 further includes projecting ribs 16 formed on the outer wall 11, extending in the direction of the axis (A) and made of a deformable material to add flexibility in thickness to the main body 1. In this embodiment, the securing member 100 is made of plastic and is slightly deformable when pressed.

The securing member 100 further includes an extending segment 15 extending from the outer wall 11 in a direction away from the end wall 13 and extending outwardly of the insertion groove 91 of the female connector member 9. The surrounding wall 81 is fittingly sandwiched by the outer wall 11 and inner wall 12 of the main body 1. It is possible that the main body 1 remains inside the insertion groove 91 of the female connector member 9 when the male connector member 8 is removed from the female connector member 9. The extending segment 15 can be held in assistance to remove the securing member 100 from the female connector member 9. The securing member 100 is shown to include one extending segment 15 in this embodiment. However, the number of the extending segment 15 is not to be limited in the present invention. In this embodiment, the main body 1 is molded as one piece.

Figure 4:
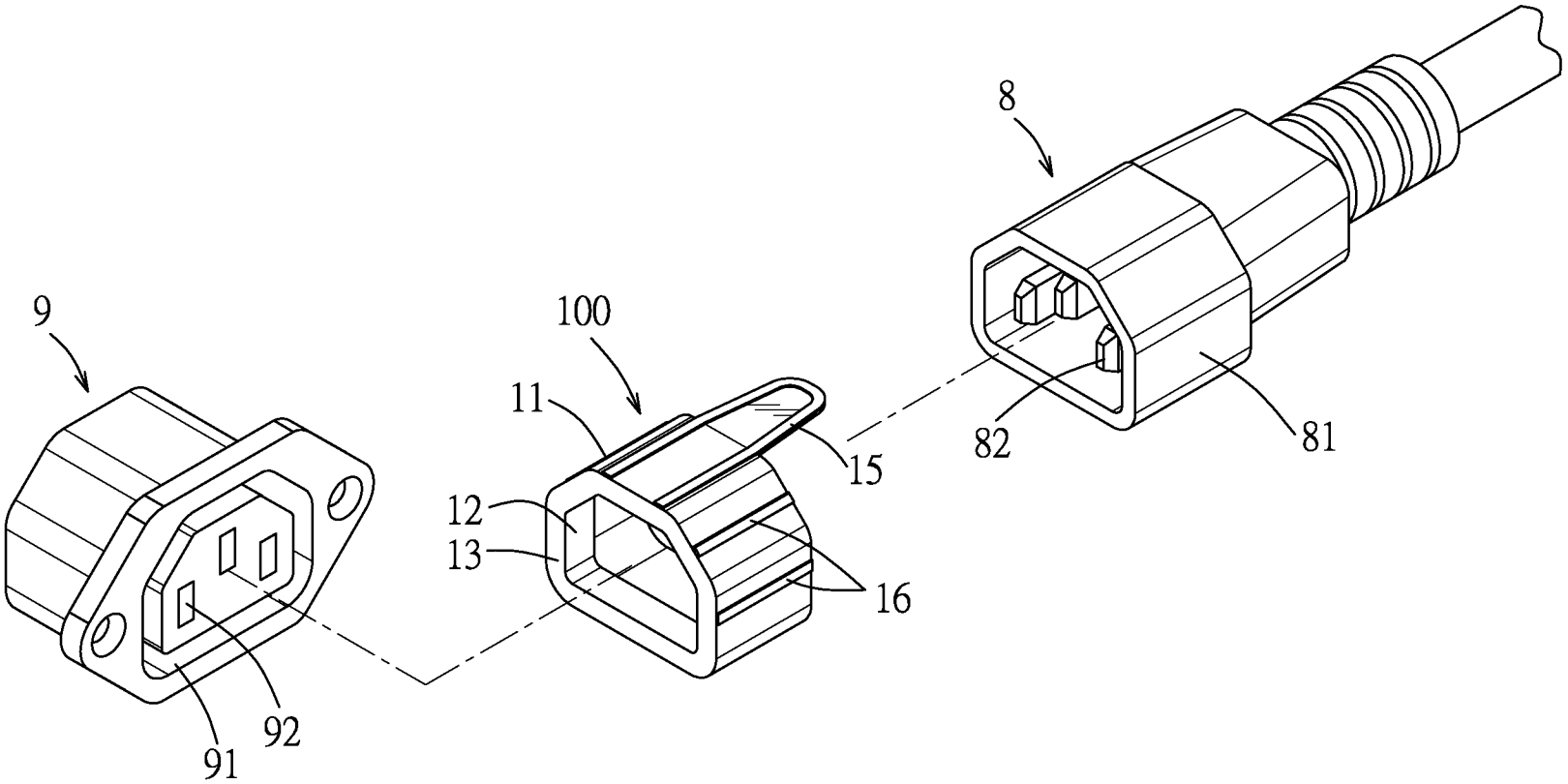
FIG. 4 is a perspective view of the second preferred embodiment of a securing member according to the present invention similar to FIG. 2, except the shape of the insertion groove is different.
Figure 5:
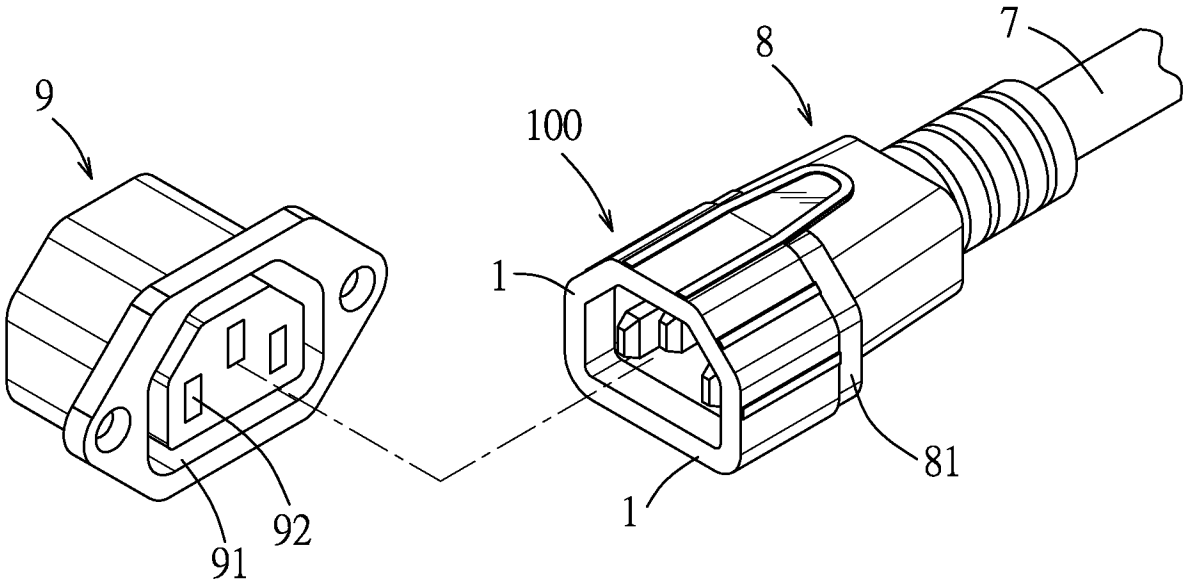
FIG. 5 is a perspective view of the second preferred embodiment similar to FIG. 3, except the shape of the insertion groove is different.

Referring to FIGS. 4 and 5, the second preferred embodiment of the securing member 100 according to the present invention is similar to the first preferred embodiment, except that the shape of the main body 1 is different to be useable with a connector of a different standard.

Figure 6:
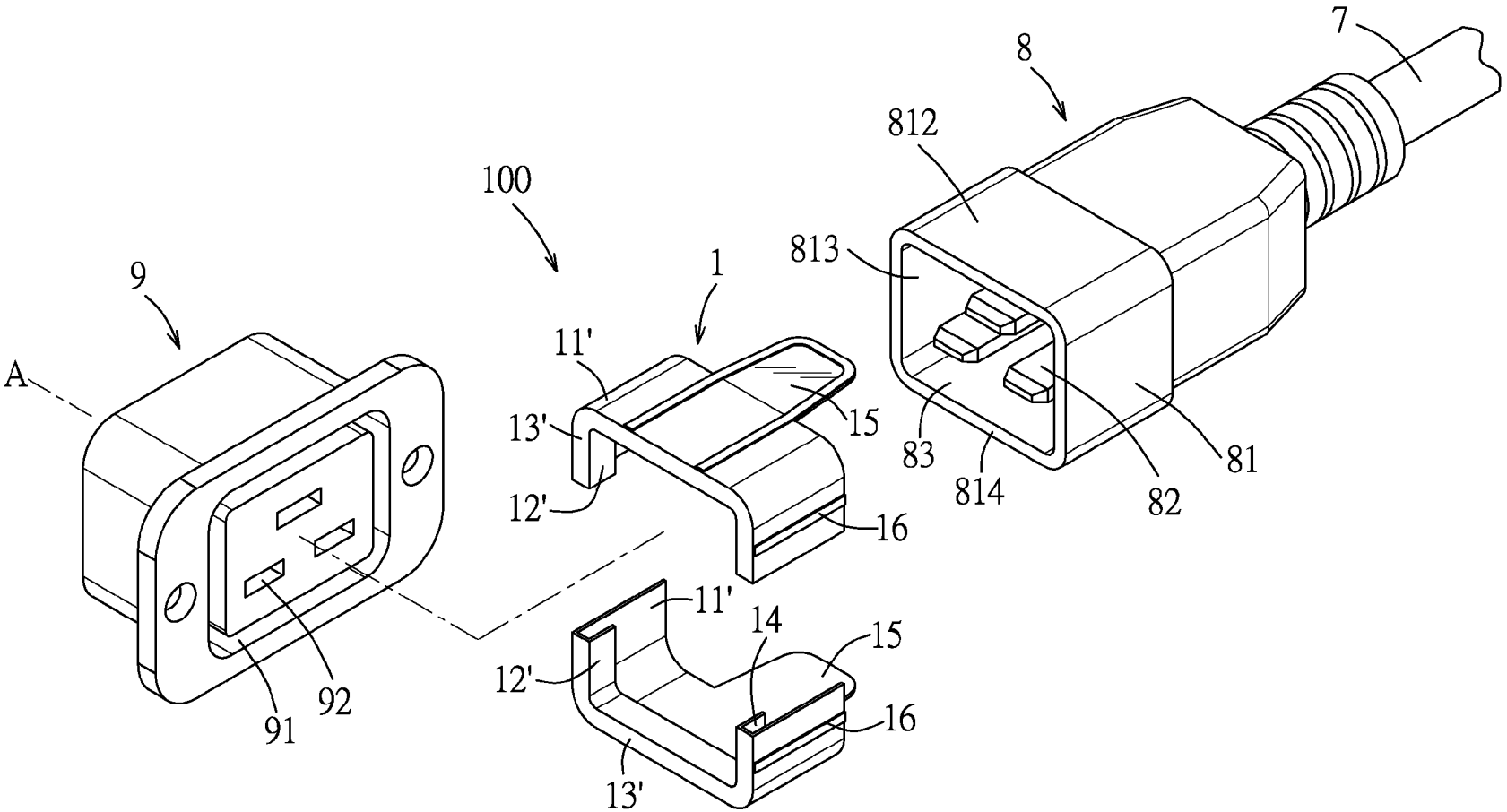
FIG. 6 is a perspective view of the third preferred embodiment of a securing member according to the present invention similar to FIG. 2, except the main body includes two sub-bodies.
Figure 7:
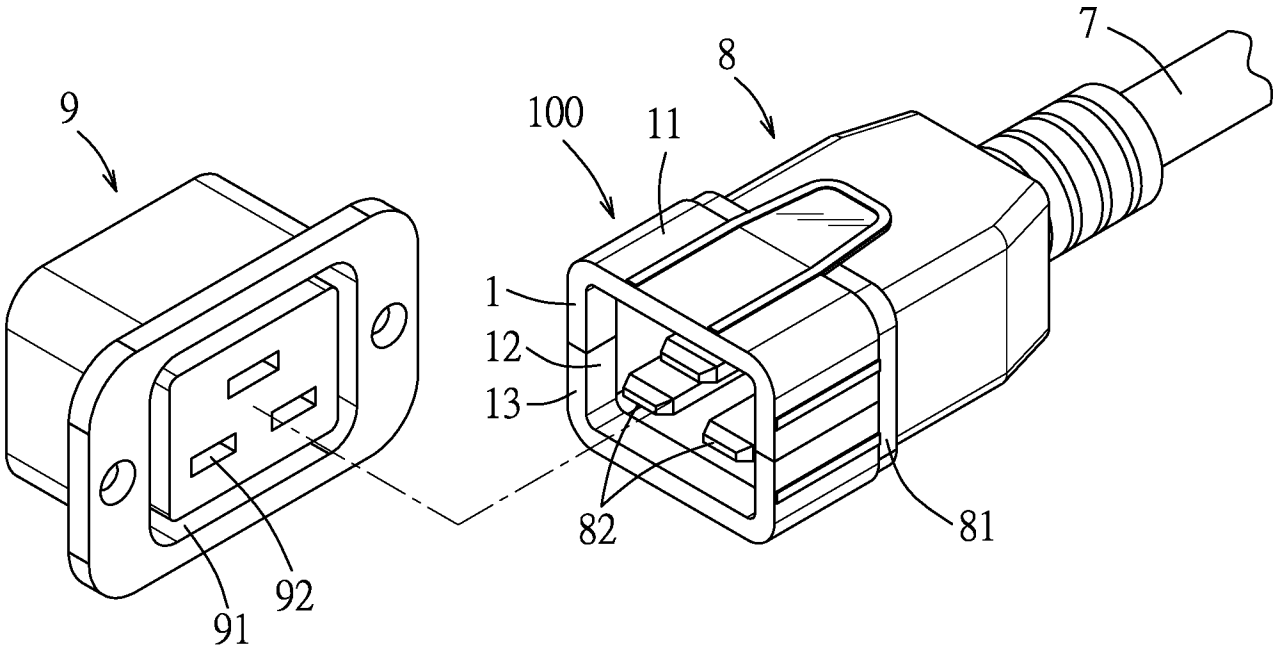
FIG. 7 is perspective view of the third preferred embodiment similar to FIG. 3, except the main body includes two sub-bodies.

Referring to FIGS. 6 and 7, the third preferred embodiment of the securing member 100 according to the present invention is similar to the first preferred embodiment, except that the main body 1 has two sub-bodies. Each of the sub-bodies has an inner wall 12' that is adapted to abut against the inner surface 813 of the open end portion 83 of the surrounding wall 81 of the male connector member 8, an outer wall 11' that surrounds the inner wall 12' and that is adapted to abut against the outer surface 812 of the open end portion 83 of the surrounding wall 81 of the male connector member 8, and an end wall 13' that interconnects the inner wall 12' and the outer wall 11' and that is adapted to abut against the distal surface 814 of the open end portion 83 of the surrounding wall 81 of the male connector member 8. The inner walls 12 of the sub-bodies cooperatively define the inner wall 12' of the main body 1. The outer walls 11' of the sub-bodies cooperatively define the outer wall 11 of the main body 1. The end walls 13' of the sub-bodies cooperatively define the end wall 13 of the main body 1. Therefore, the receiving space 14 is cooperatively defined by the inner walls 12', the outer walls 11' and the end walls 13' of the sub-bodies. Each of the sub-bodies includes an extending segment 15 so that overall, the main body 1 includes two extending segments 15 in this embodiment.

Each of the sub-bodies further has projecting ribs 16 that extend in the direction of the axis (A) and that are made of a deformable material, and an extending segment 15 that extends from the outer wall 11' in a direction away from the end wall 13' and that extends outwardly of the insertion groove 91 of the female connector 9.

Figure 8:
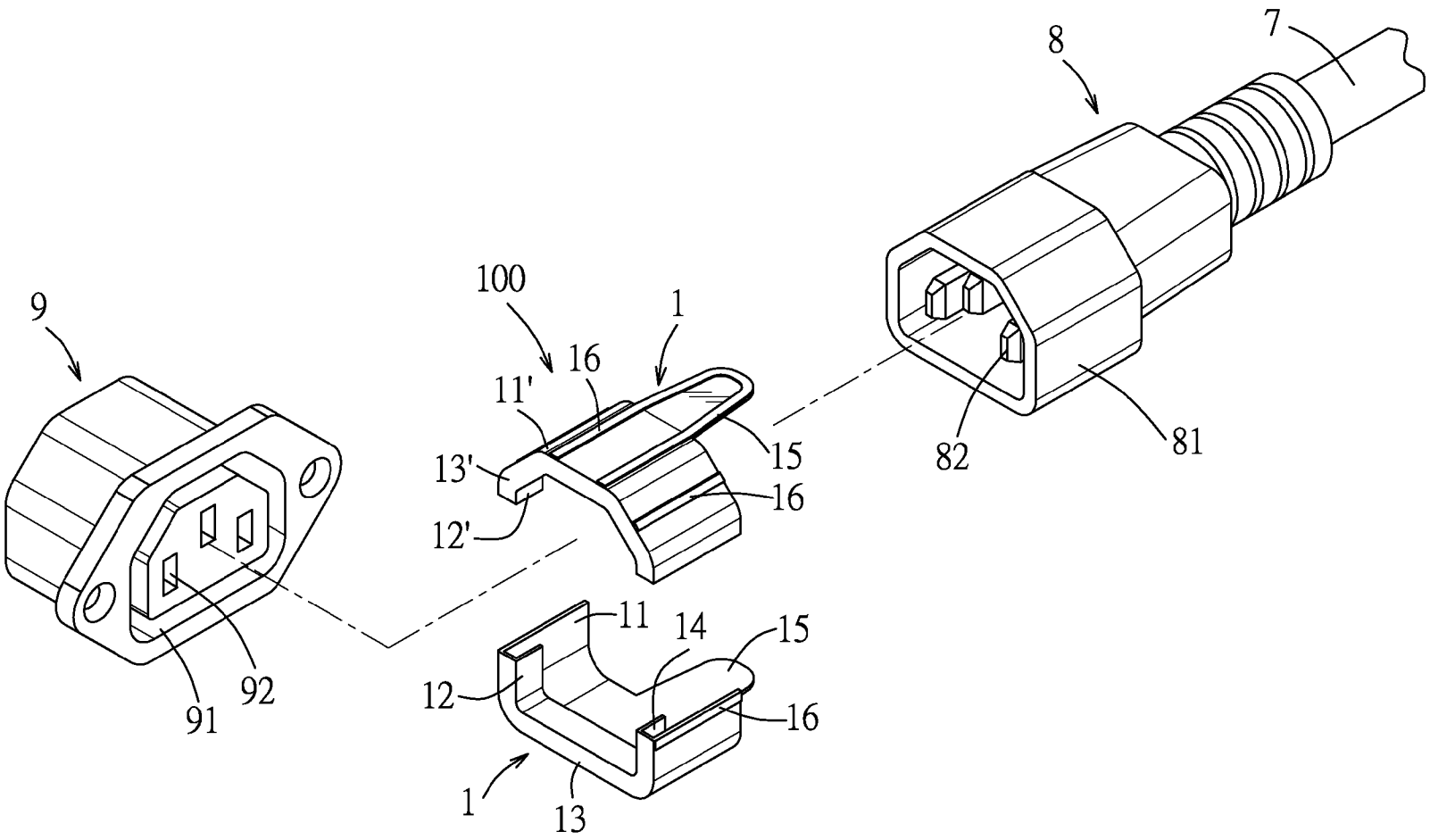
FIG. 8 is a perspective view of the fourth preferred embodiment of a securing member according to the present invention similar to FIG. 6, except the shape of the insertion groove is different.
Figure 9:
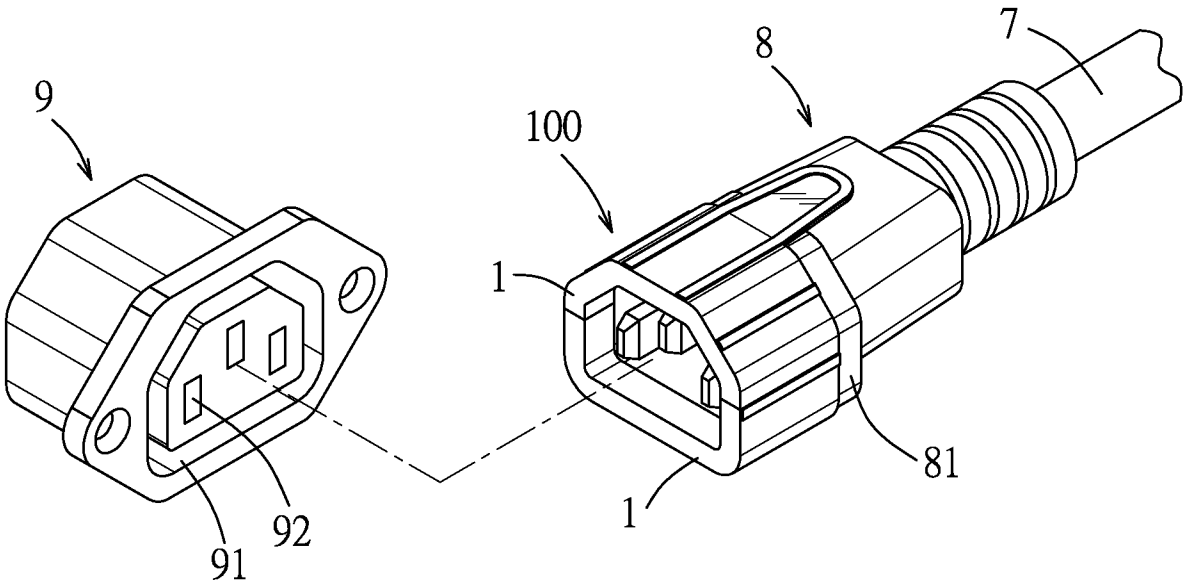
FIG. 9 is a perspective view of the fourth preferred embodiment of a securing member according to the present invention similar to FIG. 7, except the shape of the insertion groove is different.

Referring to FIGS. 8 and 9, the fourth preferred embodiment of the securing member 100 according to the present invention is similar to the third preferred embodiment, except that the shape of the main body 1 cooperatively defined the sub-bodies is different to be used with a connector in compliance with a different standard.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A securing member adapted for use in a connector, the connector including:

a female connector member that has an insertion groove surrounding an axis and a plurality of first terminals surrounded by the insertion groove, a male connector member that has a surrounding wall surrounding the axis and having an open end portion which is inserted removably into the insertion groove, and a plurality of second terminals surrounded by the surrounding wall and connected respectively, electrically and removably to the first terminals, the open end portion having an inner surface, an outer surface surrounding the inner surface, and a distal surface interconnecting the inner and outer surfaces, and a securing member comprising: a main body that includes an inner wall, an outer wall and an end wall interconnecting said inner and outer walls, said inner, outer and end walls cooperatively defining a receiving space adapted for receiving fittingly and separably at least one part of the open end portion of the surrounding wall of the male connector member, and abutting respectively and separably against the inner, outer and distal surfaces of the open end portion of the surrounding wall of the male connector member, said main body being adapted to engage fittingly and removably the insertion groove of the female connector member.

2. The securing member as claimed in claim 1, wherein said main body has a plurality of sub-bodies, each of said sub-bodies include an inner wall that is adapted to abut against the inner surface of the open end portion of the surrounding wall of the male connector member, an outer wall that surrounds said inner wall and that is adapted to abut against the outer surface of the open end portion of the surrounding wall of the male connector member, and an end wall that interconnects said inner and outer walls and that is adapted to abut against the distal surface of the open end portion of the surrounding wall of the male connector member, said inner walls of said sub-bodies cooperatively defining said inner wall of said main body, said outer walls of said sub-bodies cooperatively de fining said outer wall of said main body, said end walls of said sub-bodies cooperatively defying said end wall of said main body.

3. The securing member as claimed in claim 2, wherein each of said sub-bodies further includes an extending segment extending from said outer wall in a direction away from said end wall and extending outwardly of the insertion groove of the female connector member.

4. The securing member as claimed in claim 2, wherein each of said sub-bodies further includes a projecting rib that extends in the direction of the axis and that is made of a deformable material.

5. The securing member as claimed in claim 2, wherein each of said sub-bodies is plastic.

6. The securing member as claimed in claim 1, wherein said main body is molded as one piece.

7. The securing member as claimed in claim 6, wherein said main body further includes an extending segment extending from said outer wall in a direction away from said end wall and extending outwardly of the insertion groove of the female connector member.

8. The securing member as claimed in claim 6, wherein said main body further includes a projecting rib that extends in the direction of the axis and that is made of a deformable material.

9. The securing member as claimed in claim 6, wherein said main body is plastic.

* * * * *